United States Patent [19]

Heups

[11] Patent Number: 4,527,340

[45] Date of Patent: Jul. 9, 1985

[54] HOLDING AND GUIDING DEVICE FOR TRAVELING-CARRIAGE DRAFTING MACHINES

[75] Inventor: Gert Heups, Schwanau, Fed. Rep. of Germany

[73] Assignee: Albert Nestler GmbH, Lahr, Fed. Rep. of Germany

[21] Appl. No.: 585,193

[22] Filed: Mar. 1, 1984

[30] Foreign Application Priority Data

Apr. 9, 1983 [DE] Fed. Rep. of Germany ..... 3312853

[51] Int. Cl.[3] ..... B43L 13/02

[52] U.S. Cl. ..... 33/430; 33/438

[58] Field of Search ..... 33/403, 430, 436, 437, 33/438, 443, 174 B

[56] References Cited

U.S. PATENT DOCUMENTS

| | | | |
|---|---|---|---|
| 1,672,751 | 6/1928 | Conti | 33/174 B |
| 3,727,317 | 4/1973 | Gornowitz | 33/430 |
| 4,070,758 | 1/1978 | Watanabe | 33/438 |

*Primary Examiner*—Harry N. Haroian

*Attorney, Agent, or Firm*—Antonelli, Terry & Wands

[57] ABSTRACT

A holding and guiding device for lettering and drafting instruments adapted to be mounted on a traveling-carriage drafting machine. An additional slide rail is disposed in parallel to the vertical slide rail, with the additional slide rail carrying a slidable carriage. A flat instrument holder is provided with a pivotally mounted head, with the flat instrument holder being disposed below the additional slide rail and extending under the vertical slide rail.

15 Claims, 1 Drawing Figure

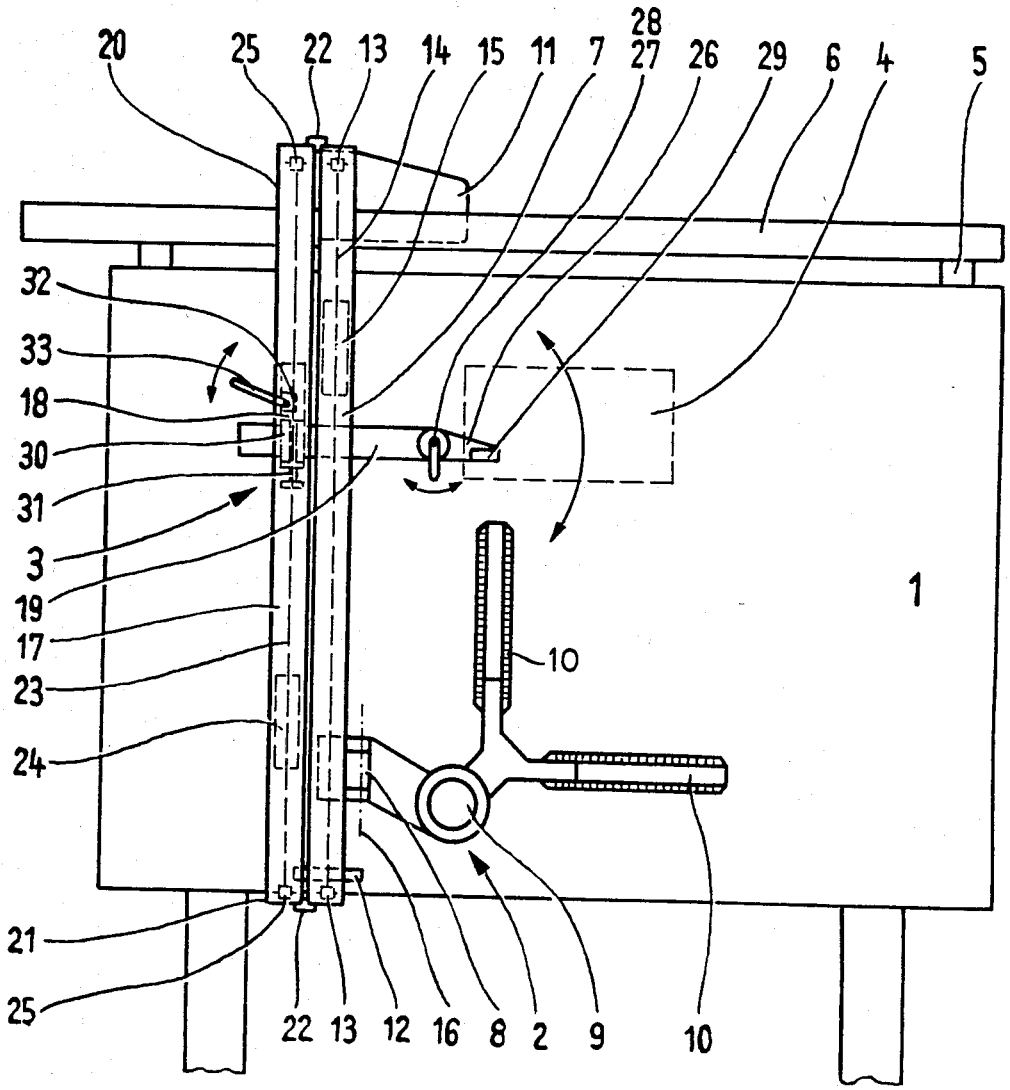
20
25
22
13
14
15
11
7
28
27
26
29
6
4
5
32
33
18
30
31
3
19
17
23
24
21
25
22
13
12
16
8
2
9
10
10
1

HOLDING AND GUIDING DEVICE FOR TRAVELING-CARRIAGE DRAFTING MACHINES

The present invention relates to a drafting arrangement and, more particularly, to a holding and guiding device for lettering and drafting instruments disposed on a traveling-carriage drafting machine having a vertical slide rail on which is arranged, on one lateral side thereof, a displacable angle adjusting head carrying drafting rods.

Recently, electronically controlled lettering instruments for engineering drawings have been proposed whereby lettering, dimension figures, as well as a large number of other symbols can be rapidly and neatly entered on drawing sheets. Lettering instruments of this of this type operate by means of an electrically moved ink writing instrument where the electrically controlled movements of the ink writing instrument are triggered by the pressing of predetermined keys of a keyboard.

For lettering of a drawing, a horizontal drafting rod is removed from a fastening of a drafting machine, with a lettering instrument being applied at an angle adjusting head of a traveling-carriage drafting machine by means of which the drawing was produced so as to enable the lettering instrument to be moved to any point of the drawing.

While there are commercially available traveling-carriage drafting machines employing holding and guiding devices for lettering and drafting instruments, a disadvantage of the available traveling-carriage drafting machines resides in the fact that not only must the drafting rod be repeatedly removed and exchanged so as to accommodate the lettering instrument, but also the lettering instrument can only be used when the drawing board is in a horizontal position because a counter balance provided for an angle adjusting head and the two drafting rods and a vertical slide rail of the traveling-carriage drafting machine does not balance the much higher weight of the applied lettering instrument.

The aim underlying the present invention essentially resides in providing a holding and guiding device for lettering and drafting instruments which enables the lettering and drafting instruments not only be used completely independently of each other but also in any pivoted or swiveled position of a drawing board to which the lettering and drafting instrument is attached.

In accordance with advantageous features of the present invention, the holding and guiding device, in the form of a traveling-carriage drafting machine, is displacably arranged on an additional slide rail detachably fastened at a slide rail in parallel and on a side thereof opposite to the angle adjusting head, with the additional slide rail having a traveling carriage where, below the additional slide rail, a flat instrument holder having a push-in head is provided reaching through under the slide rail in a direction of the angle-adjusting head.

By virtue of the above noted features of the present invention, the drafting on the drawing board can selectively take place either by means of a drafting rod of the traveling-carriage drafting machine or by means of a lettering device fastened at the instrument holder.

In accordance with further advantageous features of the present invention, the push-in head is fastened at the instrument holder by means of a pivot or swivel joint to which is applied a locking means so as to permit the arrangement of letters at any arbitrary angle.

The traveling-carriage may, in accordance with the present invention, be provided with a locking brake adapted to be actuated by a brake lever and be applied at the additional slide rail. By virtue of the provision of the locking brake, the lettering and drafting instrument is securely held in its intended position during normal use.

To further facilitate the operation of the holding and guiding device of the present invention, it is also possible to provide a detachable fastening device for the instrument holder at the traveling-carriage.

In order to make it possible to employ the lettering device in any arbitrary pivoted position of the drawing board and enable the instrument holder to remain by itself at a selected position, in accordance with still further features of the present invention, a slidable balancing weight is provided for the instrument holder and is disposed in the additional slide rail so as to ensure a precise counterweight balance for the instrument holder.

In order to prevent an unintentional detaching of the lettering instrument from the push-in head, advantageously, in accordance with the present invention, a stop or retaining spring is provided or fastened at the push-in head.

To facilitate an applying and removing of the holding and guiding device, advantageously the additional slide rail, at a top and bottom portion thereof is provided with detachable fastening means so that it is possible to employ the holding and guiding device in combination with several traveling-carriage drafting machines.

Accordingly, it is an object of the present invention to provide a holding and guiding device for lettering and drafting instruments which avoids, by simple means, shortcomings and disadvantages encountered in the prior art.

Another object of the present invention resides in providing a holding and guiding device for lettering and drafting instruments which is simple in construction and therefore relatively inexpensive to manufacture.

Yet another object of the present invention resides in providing a holding and guiding device for lettering and drafting instruments which enables the use of the lettering instrument in any pivoted position of a drawing board.

These and other object, features, and advantages of the present invention will become more apparent from the following description when taken in connection with the accompanying drawings which shows for the purposes of illustration only, one embodiment in accordance with the present invention, and wherein:

The single FIGURE of the drawing is a simplified top view of a holding and guiding device constructed in accordance with the present invention associated with a traveling-carriage drafting machine.

Referring now to the single FIGURE of the drawing, according to this FIGURE, a rectangular drawing board 1 has mounted thereon a commercially available traveling-carriage drafting machine generally designated by the reference numeral 2 on which is mounted a thereon a commercially available traveling-carriage drafting machine generally designated by the reference numeral 2 on which is mounted a holding and guiding device generally designated by the reference numeral 3 for a lettering and drafting instrument 4. The traveling-carriage drafting machine 1 is secured to the drawing board 1 by two fastening means 5 such as, for example, screws or the like, and includes a horizontally extending slide rail 6, a vertically extending slide rail 7, a carriage 8, an angle adjusting head 9, and two drafting rods 10 disposed at a right angle with respect to one another. A carriage 11 is displacably mounted along an upper end of the vertical slide rail 7, with the carriage 11 being provided with rollers or the like accommodated in guides provided in the horizontal slide rail 6. A pair of rubber-reinforced wheels 12 are disposed at the lower end of the vertical slide rail 7 and move along a lower end of the drawing board 1. The carriage 8 is adapted to more along the vertical slide rail 7 by, for example, rollers (not shown), and is connected with a counter balance weight 15 by an endless band 14 wound around rollers 13 respectively disposed at the upper and lower ends of the vertical slide rail 7. A hinge means pivotally mounts the angle adjusting head 9 to the carriage 8, with the hinge means having a pivot axis 16 extending in parallel to the vertical slide rail 7.

The holding and guiding device 3 includes an additional hollow slide rail 17, a carriage 18, and an instrument holder 19, with the additional slide rail 17 being arranged in parallel to and at a short distance from the vertical slide rail 7 of the traveling-carriage drafting machine 2. The additional slide rail 17 is disposed on a side of the slide rail opposite the angle adjusting head 9, with the additional slide rail 17 being connected with the upper and lower ends of the vertical slide rail 7 of the traveling-carriage drafting machine 2 by fastening means 22 such as, for example, screws of the like, disposed at the upper end 20 and lower end 21 of the slide rail 17. Advantageously, the fastening means 22 are constructed so as to be easily manually removable.

The carriage 18 is, for example, provided with four rollers (not shown) adapted to run in parallel guides disposed at an underside of the additional slide rail 17. The carriage 18 is connected by, for example, a rope 23 or the like with a balancing weight 24 running back and forth on rollers (not shown) on the inside of the additional hollow slide rail 17. The rope 23 is tightly stretched over two deflection rollers 25 respectively provided at the upper and lower ends 20, 21 of the additional slide rail 17. The weight of the balancing weight 24 corresponds to the sum of the weights of the carriage 18, the instrument holder 19, and the lettering and drafting instrument 4.

Advantageously, the instrument holder 19 is substantially flat and is formed of a flat metal band extending under the vertical slide rail 7 of the traveling-carriage drafting machine 2 in a direction of the angle adjusting head 9. The instrument holder 19 is disposed at a right angle to and below the additional slide rail 17, and is detachably mounted at the traveling-carriage 18 so as to be horizontally slidably displacable. When the angle adjusting head 9 of the traveling-carriage drafting machine 2 is swiveled or pivoted upwardly about the pivot axis 16, the instrument holder 19 with the lettering and drafting instrument 4 may be pushed under the traveling-carriage 8.

The instrument holder 19 includes a push-in head 26 formed of a flat metal band which, by means of a pivot joint 27, can be pivoted at the level of the drawing board 1. A locking means 28 is applied at the pivot joint 27 for enabling a locking of the push-in head 26. A dovetailed groove (not shown) is provided at an end and bottom side of the head 26 for enabling a pushing-in of the lettering and drafting instrument 4 which, in turn, is provided with a corresponding dovetail. A manually adjustable locking spring 29 prevents an unintentional detachment of the lettering and drafting instrument which is pivotable with respect to the horizontal by the pivot joint 27.

The instrument holder 19 is fastened at the traveling-carriage 18 by means of a detachable fastening means 30 having a substantially U-shaped cross sectional configuration. A back or bite portion of the U-shaped fastening means is fastened by, for example, a screw or the like, to the traveling-carriage 18, with downwardly extending legs of the U-shaped fastening means 30 being provided with grooves in which the instrument holder is slidably displaced. The fastening means 30 is operated by a threaded member 31 such as, for example, a screw of the like, disposed in parallel to the additional slide rail 17, with the head of the threaded member 31 having a small lever thereon. The threaded member 31 pulls or draws the two-U-shaped legs of the fastening means 30 toward one another as the threaded member 31 is fastened thereby pressing the legs against the edges of the instrument holder 19.

A locking brake 32 is disposed at the traveling-carriage 18, with the brake 32 being adapted to be applied to one of the guide of the additional slide rail 17 and to be tightened and released by a pivotal displacement of the brake lever 33 in the direction of the double arrow. During a use of the lettering and drafting instrument 4, the locking brake 32 prevents an unintentional shifting of the lettering and drafting instrument 4 in a horizontal direction, while a vertical shifting of the lettering and drafting instrument 4 is prevented by a tightening of the brake of the vertical slide rail 7 of the traveling-carriage drafting machine 2.

While I have shown and described only one embodiment in accordance with the present invention, it is understood that the same is not limited thereto but is suscepible of numerous changes and modifications as known to one having ordinary skill in the art and I therefore do not wish to be limited to the details shown and described herein, but intend to cover all such modifications as are encompassed by the scope of the appended claims.

I claim:

1. A holding and guiding device for lettering and drafting instruments adapted to be mounted on a traveling-carriage drafting machine having a vertical slide rail and a laterally extending angle-adjusting head means for carrying drafting rods slidably mounted on the slide rail, the holding and guiding device comprising an additional slide rail, means for detachably securing the additional slide rail to said vertical slide rail, said additional slide rail being disposed in parallel to the vertical slide rail and disposed on a side opposite the vertical slide rail to the angle adjusting head means, a traveling-carriage means mounted on said additional slide rail, a substantially flat instrument holder means mounted to said traveling carriage means so as to extend below said additional slide rail in a direction of the angle adjusting head means, and means provided at the end of the instrument holder means for accommodating the lettering and drafting instruments.

2. A holding and guiding device according to claim 1, wherein a pivot means is provided for pivotally connecting the means for accommodating to the instrument holder means, and locking means are provided for locking the means for accommodating in an adjusted position relative to the instrument holder means.

3. A holding and guiding device according to claim 2, wherein a brake means is provided at the traveling-carriage means for locking the traveling-carriage means along the additional slide rail, and means are provided for actuating said brake means.

4. A holding and guiding device according to claim 3, wherein means are provided for detachably fastening the instrument holder means to the traveling carriage means.

5. A holding and guiding device according to claim 4, wherein means are disposed in the additional slide rail and are connected to the instrument holder means for counter-balancing a weight of the instrument holder means.

6. A holding and guiding device according to claim 5, wherein means are provided for preventing an unintentional detachment of the letter and drafting instruments from said instrument holder means.

7. A holding and guiding device according to claim 6, wherein said means for preventing unintentional detachment includes a locking spring means.

8. A holding and guiding device according to claim 6, wherein means are provided at an upper and a lower end of said additional slide rail for enabling a detachment of said additional slide rail from said vertical rail.

9. A holding and guiding device according to claim 1, wherein a brake means is provided at the traveling-carriage means for locking the traveling-carriage means along the additional slide rail, and means are provided for actuating said brake means.

10. A holding and guiding device according to claim 1, wherein means are provided for detachably fastening the instrument holder means to the traveling carriage means.

11. A holding and guiding device according to claim 1, wherein means are disposed in the additional slide rail means and are connected to the instrument holder means for counter-balancing a weight of the instrument holder means.

12. A holding and guiding device according to claim 1, wherein means are provided for preventing an unintentional detachment of the letter and drafting instrument from said instrument holder means.

13. A holding and guiding device according to claim 1, wherein means are provided at an upper and a lower end of said additional slide rail for enabling a detachment of said additional slide rail from said vertical slide rail.

14. A holding and guiding device according to claim 13, wherein a pivot means is provided for pivotally connecting the means for accommodating to the instrument holder means, and locking means are provided for locking the means for accommodating in an adjusted position relative to the instrument holder means.

15. A holding and guiding device according to claim 14, wherein brake means is provided at the traveling-carriage means for locking the traveling-carriage means along the additional slide rail, and means are provided for actuating said brake means.

* * * * *